US009949011B2

(12) United States Patent
Jen

(10) Patent No.: US 9,949,011 B2
(45) Date of Patent: Apr. 17, 2018

(54) EARPHONE KEEPER

(71) Applicant: Jimmy Jen, San Jose, CA (US)

(72) Inventor: Jimmy Jen, San Jose, CA (US)

( * ) Notice: Subject to any disclaimer, the term of this patent is extended or adjusted under 35 U.S.C. 154(b) by 0 days.

(21) Appl. No.: 15/206,102

(22) Filed: Jul. 8, 2016

(65) Prior Publication Data

US 2017/0013344 A1 Jan. 12, 2017

Related U.S. Application Data

(60) Provisional application No. 62/190,663, filed on Jul. 9, 2015.

(51) Int. Cl.

| | |
|---|---|
| ***H04R 25/00*** | (2006.01) |
| ***H04R 1/10*** | (2006.01) |
| ***H04R 5/033*** | (2006.01) |

(52) U.S. Cl.

CPC ..... *H04R 1/1033* (2013.01); *H04R 1/105* (2013.01); *H04R 1/1058* (2013.01); *H04R 1/1091* (2013.01); *H04R 5/033* (2013.01); *H04R 1/1016* (2013.01); *H04R 2201/023* (2013.01); *H04R 2420/07* (2013.01)

(58) Field of Classification Search

CPC ..... H04R 1/10; H04R 1/1016; H04R 1/1033; H04R 1/105; H04R 1/1058; H04R 5/033; H04R 5/0335; H04R 2201/023; H04R 2420/07; H04R 2499/11; H04M 1/05; H04M 1/15

USPC ..... 381/301, 309, 370, 374, 380, 384, 385, 381/74, 376, 379; 379/430, 438; 181/129, 130, 135

See application file for complete search history.

(56) References Cited

U.S. PATENT DOCUMENTS

| | | | | |
|---|---|---|---|---|
| 7,436,974 | B2 | 10/2008 | Harper | |
| 8,121,304 | B2 | 2/2012 | Bales et al. | |
| 8,249,286 | B2 | 8/2012 | Nault | |
| 8,265,325 | B2 | 9/2012 | Park | |
| 8,290,193 | B2 | 10/2012 | Pang et al. | |
| 8,455,758 | B2 | 6/2013 | Groset et al. | |
| 8,798,305 | B2 * | 8/2014 | Harper | H04R 1/1016 381/374 |
| 8,891,798 | B1 | 11/2014 | de Mazieres et al. | |
| 9,288,566 | B2 * | 3/2016 | Minarik | H04R 1/1033 |
| 2003/0169896 | A1 | 9/2003 | Kirk, III et al. | |

(Continued)

FOREIGN PATENT DOCUMENTS

| | | |
|---|---|---|
| CN | 201194426 | 2/2009 |
| CN | 204362262 | 5/2015 |

(Continued)

*Primary Examiner* — Huyen D Le

(74) *Attorney, Agent, or Firm* — Womble Bond Dickinson (US) LLP

(57) ABSTRACT

An earphone keeper having a jack clip to attach to an audio jack, several earphone clips to attach to respective speaker housings of a pair of earphones, and securement features that releasably couple the earphone clips to the jack clip, is disclosed. More particularly, an embodiment includes a magnet in the jack clip to magnetically attract soft magnetic inserts in the earphone clips such that the speaker housings are releasably retained at the audio jack and cable portions of the earphones resist tangling. Other embodiments are also described and claimed.

19 Claims, 11 Drawing Sheets

(56) References Cited

U.S. PATENT DOCUMENTS

| | | | | |
|---|---|---|---|---|
| 2007/0121987 | A1* | 5/2007 | Fielding, Jr. ..... | H04R 1/1033 381/385 |
| 2009/0238395 | A1 | 9/2009 | Jubelirer et al. | |
| 2011/0110552 | A1* | 5/2011 | Pang ..... | H04R 1/1033 381/374 |
| 2011/0170733 | A1 | 7/2011 | Aase et al. | |
| 2013/0048341 | A1 | 2/2013 | Walder et al. | |
| 2014/0010400 | A1 | 1/2014 | Morris | |
| 2014/0116774 | A1 | 5/2014 | Aase et al. | |
| 2014/0140561 | A1 | 5/2014 | Lee et al. | |
| 2015/0163580 | A1 | 6/2015 | Wallaja et al. | |
| 2015/0365755 | A1* | 12/2015 | Harper ..... | H04R 1/1033 381/384 |

FOREIGN PATENT DOCUMENTS

| | | |
|---|---|---|
| JP | H0414399 | 1/1992 |
| KR | 20110118905 | 11/2011 |
| KR | 101165181 | 7/2012 |
| WO | WO2014090538 A1 | 6/2014 |

* cited by examiner

EARPHONE KEEPER

This application claims the benefit of U.S. Provisional Patent Application No. 62/190,663, filed Jul. 9, 2015, and this application hereby incorporates herein by reference that provisional patent application in its entirety.

BACKGROUND

Field

Embodiments related to earphone keepers, are disclosed. More particularly, embodiments relate to earphone keepers for preventing tangling of earphone cables.

Background Information

Consumer electronics device, such as mobile phones, desktop computers, laptop computers, tablet computers, or portable media devices, typically include plugs for providing an audio output. Headphones are commonly used by consumers to listen to the audio output. For example, ear-fitting headphones, also known as earphones, may be plugged into the consumer electronics device to consume music.

SUMMARY

Earphones, such as intra-aural headphones (also known as "earbuds") and intra-canal headphones (also known as "canalphones") typically include an audio jack connected to a pair of speakers by a cable. Furthermore, the cable generally bifurcates midway between the jack and the speakers, such that the earphones essentially include three individual lengths of cable that can move freely relative to one another. The unconstrained movement of the speakers relative to the audio jack can result in tangling of the cable when the speakers are not placed in the ears of a user. For example, the earphones may tend to become tangled when stored in a pocket or a bag during transport. Untangling the earphones can be time-consuming and frustrating for the user.

In an embodiment, an earphone keeper for preventing tangling of earphone cables is provided. The earphone keeper may include a jack clip and several earphone clips. The jack clip may have a jack clip body or wall surrounding a jack channel to receive an audio jack of a pair of earphones. Furthermore, the earphone clips may include an earphone clip body or wall surrounding respective earphone clip channels to receive a speaker housing of each speaker of the pair of earphones. Each of the earphone clips may be releasably coupled to the jack clip. For example, the jack clip may include a magnet that generates a magnetic field having magnetic field lines that extend, e.g., transverse to, an axis running through the jack channel. Furthermore, the earphone clips may include magnetic inserts such that, when an earphone clip is brought into a proximity of the jack clip, the magnetic insert is attracted to the magnet to releasably couple the earphone clip with the jack clip. The earphone clip may include a protrusion to engage with a recess in the jack clip, and to retain the earphone clip in an interlocked state with the jack clip.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

DETAILED DESCRIPTION

Embodiments describe an earphone keeper for preventing tangling of earphones. However, while some embodiments are described with specific regard to use with earphones, the embodiments are not so limited and certain embodiments may also be applicable to other uses. For example, an earphone keeper as described below may be used to manage cables of other devices or accessories, such as power and/or data cables of computers, power supplies, etc.

In various embodiments, description is made with reference to the figures. However, certain embodiments may be practiced without one or more of these specific details, or in combination with other known methods and configurations. In the following description, numerous specific details are set forth, such as specific configurations, dimensions, and processes, in order to provide a thorough understanding of the embodiments. In other instances, well-known processes and manufacturing techniques have not been described in particular detail in order to not unnecessarily obscure the description. Reference throughout this specification to "one embodiment," "an embodiment," or the like, means that a particular feature, structure, configuration, or characteristic described is included in at least one embodiment. Thus, the appearance of the phrase "one embodiment," "an embodiment," or the like, in various places throughout this specification are not necessarily referring to the same embodiment. Furthermore, the particular features, structures, configurations, or characteristics may be combined in any suitable manner in one or more embodiments.

The use of relative terms throughout the description may denote a relative position or direction. For example, "upper" may indicate a first direction away from a reference point. Similarly, "lower" may indicate a location in a second direction opposite to the first direction. However, such terms are provided to establish relative frames of reference, and are not intended to limit the use or orientation of an earphone keeper to a specific configuration described in the various embodiments below.

In an aspect, an earphone keeper includes a jack clip to attach to an earphone jack and an earphone clip to attach to a speaker housing of the earphone. Furthermore, the jack clip and the earphone clip may be releasably coupled to each other, e.g., through magnetic attraction. Accordingly, the earphone jack and the speaker housing may be maintained in a close relationship during storage to reduce a likelihood of tangling of their respective cable lengths.

Figure 1:
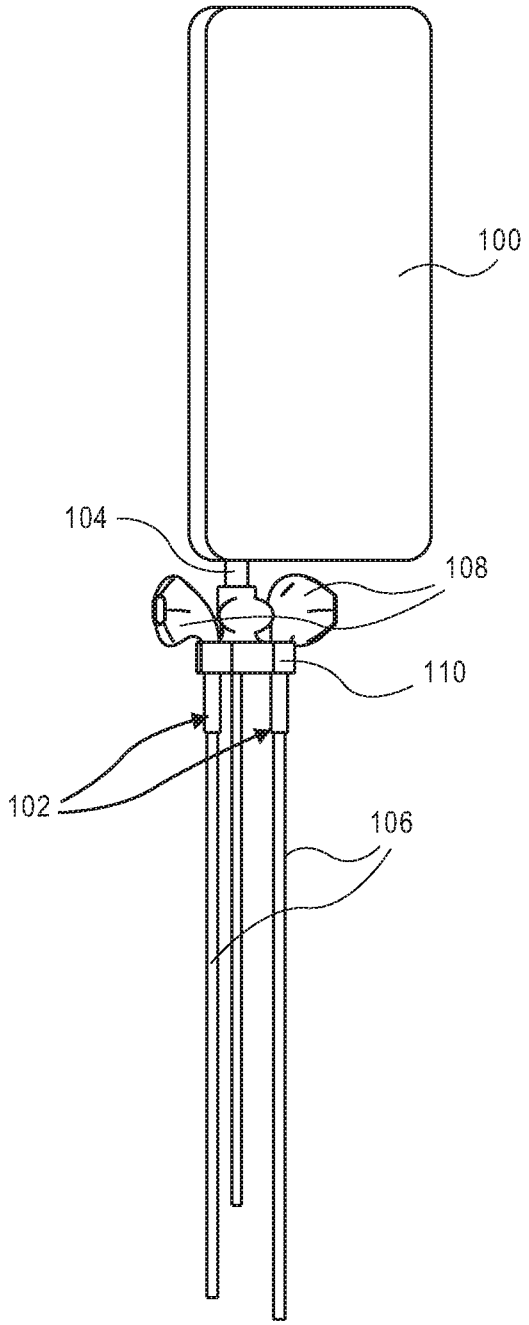
FIG. 1 is a perspective view of earphones plugged into an electronic device in accordance with an embodiment.

Referring to FIG. 1, a perspective view of earphones plugged into an electronic device is shown in accordance with an embodiment. In an embodiment, an electronic device 100 is a portable consumer electronics device, and more particularly, is a smart phone. The electronic device 100 includes a housing, display, and interface elements (e.g., buttons). The housing encloses internal circuitry that provides the electronic device 100 with certain functionality, such as telephony and media playback capability. In other embodiments, the electronic device 100 may be a portable or non-portable consumer electronics devices, e.g., a tablet computer, laptop or notebook computers, and/or other devices having audio output such as a car stereo.

The electronic device 100 may provide audio output associated with audio files through an audio port or plug (not shown) to a pair of earphones 102. More particularly, an audio jack 104 of the earphones 102 may be plugged into the audio port to receive an audio signal and deliver the audio signal through a cable 106 to one or more earphone speakers located in speaker housings 108. As shown, a speaker housing 108 may be shaped to fit into a user's ear, e.g., at an intra-aural or intra-canal location, to emit sound into the user's ear during audio reproduction.

When not in use, the earphones 102 may be kept in a predetermined position by an earphone keeper 110. More particularly, the earphone keeper 110 may hold the audio jack 104 and the speaker housing 108 close together such that the cable 106 lengths connected in between them do not become tangled. In an embodiment, the earphone keeper 110 includes several attachment mechanisms, such as clips, that attach separately to different locations on the earphones 102. For example, a first attachment mechanism may attach to the audio jack 104 and a second attachment mechanism may attached to the speaker housing 108. The individual attachment mechanisms may also be releasably coupled to each other to allow the speaker housings 108 to be quickly separated from the audio jack 104 for placement in the user's ears.

Figure 2:
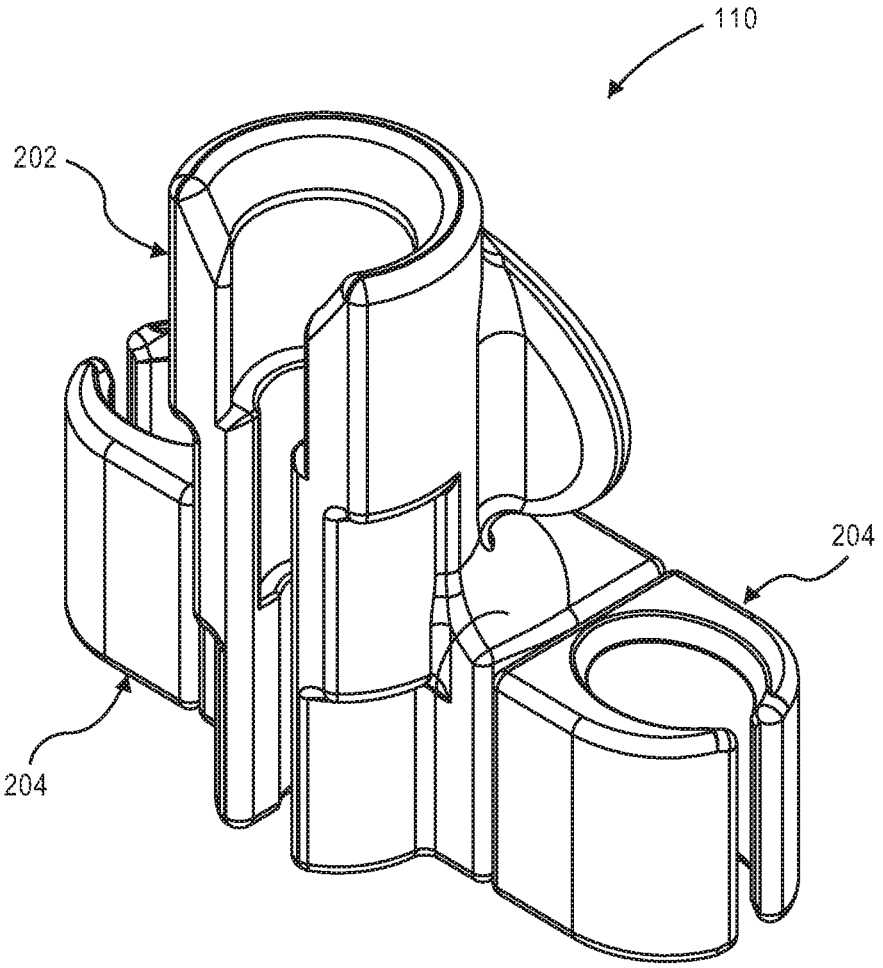
FIG. 2 is a perspective view of an earphone keeper having earphone clips releasably coupled to a jack clip in accordance with an embodiment.

Referring to FIG. 2, a perspective view of an earphone keeper having earphone clips releasably coupled to a jack clip is shown in accordance with an embodiment. Earphone keeper 110 may include a jack clip 202 portion to attach to the audio jack 104 and one or more earphone clip 204 portions to attach to the speaker housings 108. More particularly, jack clip 202 may attach to the audio jack 104 or to any location along earphones 102 between the audio jack 104 and a bifurcation point along the cable 106, e.g., where cable 106 splits into a left channel cable and a right channel cable. Similarly, the earphone clips 204 may be connected to a respective speaker housing 108 or at any location along earphones 102 between a respective speaker housing 108 and the bifurcation point along the cable 106. Accordingly, the jack clip 202 and the earphone clips 204 may hold respective portions of the earphones 102, e.g., different lengths of the earphone cable 106, and bring locations on those portions together to a common position. Maintaining a relative position between portions may reduce relative movement between the portions and therefore may reduce the likelihood of cable 106 tangling.

Figure 3:
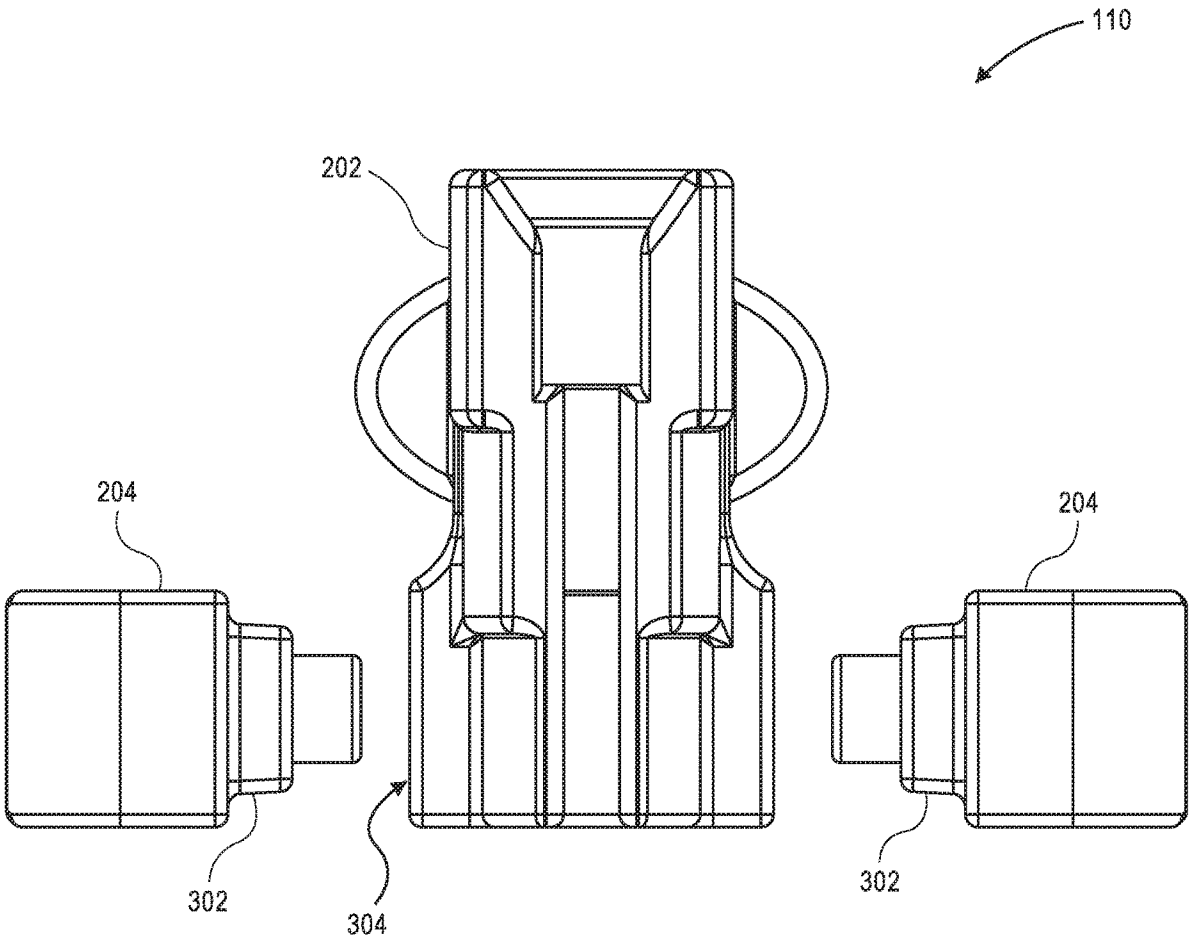
FIG. 3 is an exploded side view of an earphone keeper having earphone clips detached from a jack clip in accordance with an embodiment.

Referring to FIG. 3, an exploded side view of an earphone keeper having earphone clips detached from a jack clip is shown in accordance with an embodiment. The earphone clips 204 of the earphone keeper 110 may be engaged and disengaged from the jack clip 202. More particularly, each earphone clip 204 may have a securement feature, such as a protrusion 302, which mates, meshes, or otherwise engages with a complementary securement feature of the jack clip 202. The complementary securement feature of the jack clip 202 may be, for example, a recess 304 or counterbore (hidden in the jack clip 202 body in FIG. 3) that receives the protrusion 302 in such a way that the earphone clip 204 is cantilevered from the jack clip 202. Embodiments of the securement features of the jack clip 202 and the earphone clips 204 are described further below.

Figure 4:
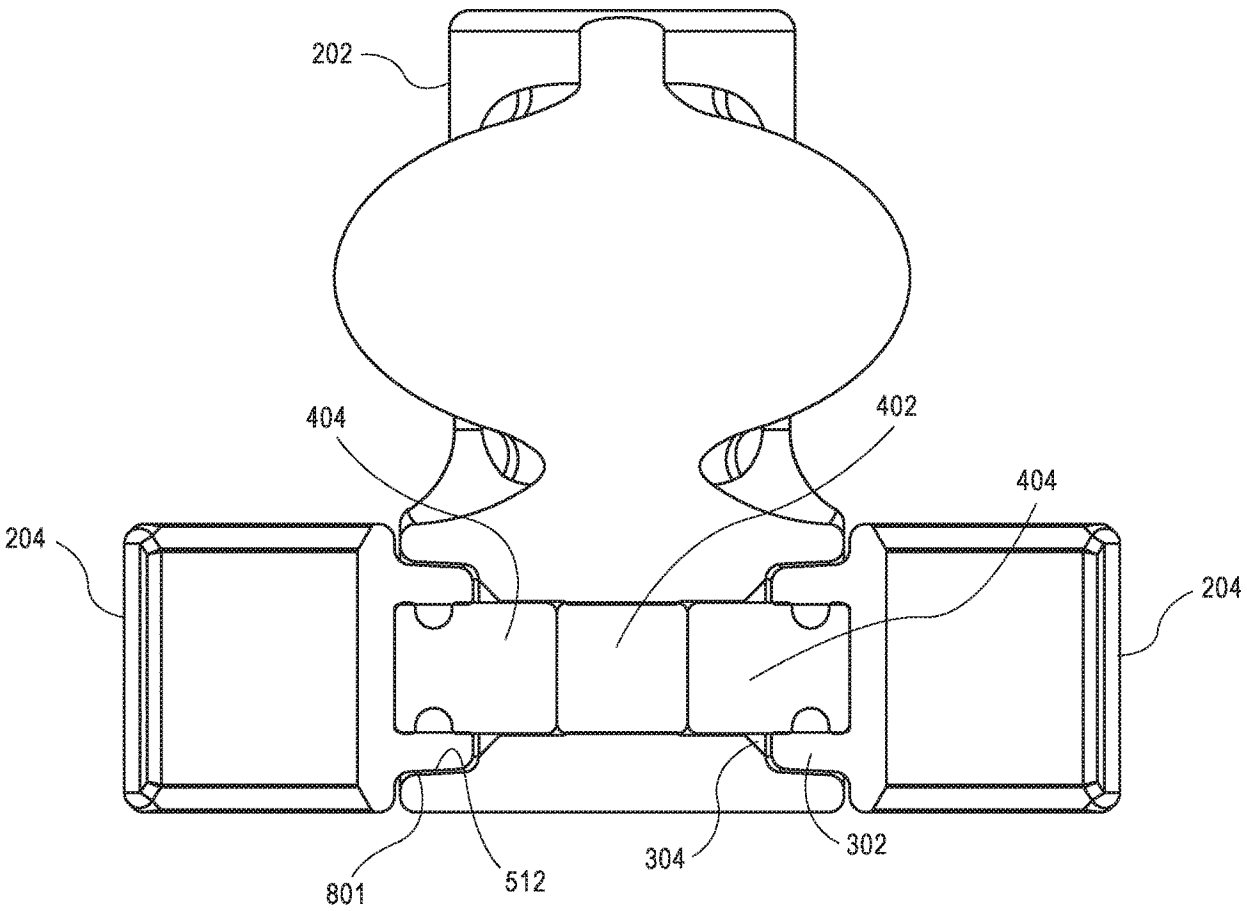
FIG. 4 is a sectional view of an earphone keeper having earphone clips attached to a jack clip in accordance with an embodiment.

Referring to FIG. 4, a sectional view of an earphone keeper having earphone clips attached to a jack clip is shown in accordance with an embodiment. In addition to securement features, the earphone keeper 110 may include retention features on both the jack clip 202 and the earphone keepers 110 to retain the earphone clips 204 at the jack clip 202 when the securement features are engaged. As shown, an earphone clip 204 is engaged with the jack clip 202 when the protrusion 302 of the earphone clip 204 is inserted into the recess 304 of the jack clip 202. Furthermore, the jack clip 202 may include one or more magnets 402, e.g., permanent magnets, located near the recess 304 such that a magnetic pole of the magnet 402 faces toward the recess 304. As such, the magnet 402 generates a magnetic field having magnetic field lines that are directed into the recess 304 and toward the earphone clip 204 when the earphone clip 204 is engaged with the jack clip 202. The earphone clips 204 may also include magnetic portions that are attracted to the magnets 402 in the jack clip 202. For example each earphone clip 204 may have a magnet or a soft magnetic insert 404 that is located within the magnetic field of the jack clip magnet 402 when the earphone clip 204 is engaged with the jack clip 202. The earphone clip magnetic inserts 404 may be permanent magnets, like the jack clip magnet 402, or may be formed from a magnetic material that is magnetically attracted to the jack clip magnet 402. In an embodiment, the magnetic inserts 404 are not attracted to each other. For example, the magnetic inserts 404 may be formed from magnetic materials, e.g., carbon steel, that is magnetically attracted to a permanent magnet, but not to itself.

As described above, a magnetic pole of the magnet 402 in the jack clip 202 may direct magnetic field lines into the recess 304, and in an embodiment, the magnetic field lines may be transverse to the jack clip channel 502. However, a portion of the magnetic field lines may be parallel to the jack clip channel 502. For example, the magnetic field lines may radiate in a direction orthogonal to the field lines entering/exiting the poles, and thus have some directional component parallel to the channel. Furthermore, in an embodiment, the magnet 402 may be oriented such that the magnetic field lines are directed from the pole parallel to the channel. This could allow, for example, the corresponding magnetic inserts 404 of the earphone clips 204 to be attracted to the magnet 402 in the jack clip 202 parallel to the channel, and thus, the earphone clips 204 may be slid into engagement with the jack clip 202 along the channel axis, e.g., like a hook being inserted into a loop. It will be appreciated that the magnetic field lines may be directed in other, non-parallel or non-perpendicular directions relative to the jack clip channel 502 also, in accordance with this description.

In an alternative embodiment, the jack clip 202 includes a magnetic material, such as a soft magnetic insert material, rather than a permanent magnet, and the earphone clips 204 include permanent magnet insert material, rather than soft magnetic insert material. Thus, one or more of the jack clip 202 or the earphone clip(s) 204 may include a permanent magnet 402 and another of the jack clip 202 or the earphone clip(s) 204 may include a soft magnetic insert 404 to provide a magnetic attraction between the components. It will be appreciated, however, that having soft magnetic inserts 404 that are not permanent magnets in the earphone clips 204, as described above, may reduce the likelihood of the earphone clips 204 attaching to a user's jewelry, such as metallic earrings, necklaces, and zippers.

In addition to using mating magnets and/or magnetic materials to engage earphone clip(s) 204 and jack clip 202, mechanical engagement may be employed. For example, engagement between earphone clip(s) 204 and jack clip 202 may be maintained by a mechanical interference between respective features and/or surfaces of the components. In an embodiment, a mechanical engagement feature includes a spring-loaded detent. For example, a spring-loaded detent may be embedded in a surface of earphone clip 204 or jack clip 202. The detent may retract slightly when earphone clip 204 is inserted into jack clip 202, and thus, the detent may press against the mating part or insert into a bore of the mating part to provide a retention force between the components. In an embodiment, a mechanical engagement feature includes an O-ring. For example, an O-ring may be mounted on a surface of earphone clip 204 or jack clip 202. The O-ring may deform, e.g., squeeze, when earphone clip 204 is inserted into jack clip 202, and thus, the O-ring may press against the mating part or insert into a groove of the mating part to provide a retention force between the components. Mechanical engagement between earphone clip 204 and jack clip 202 may likewise be achieved by a press fit, set screw, and other mechanical interlock features using mechanical interference.

Figure 5:
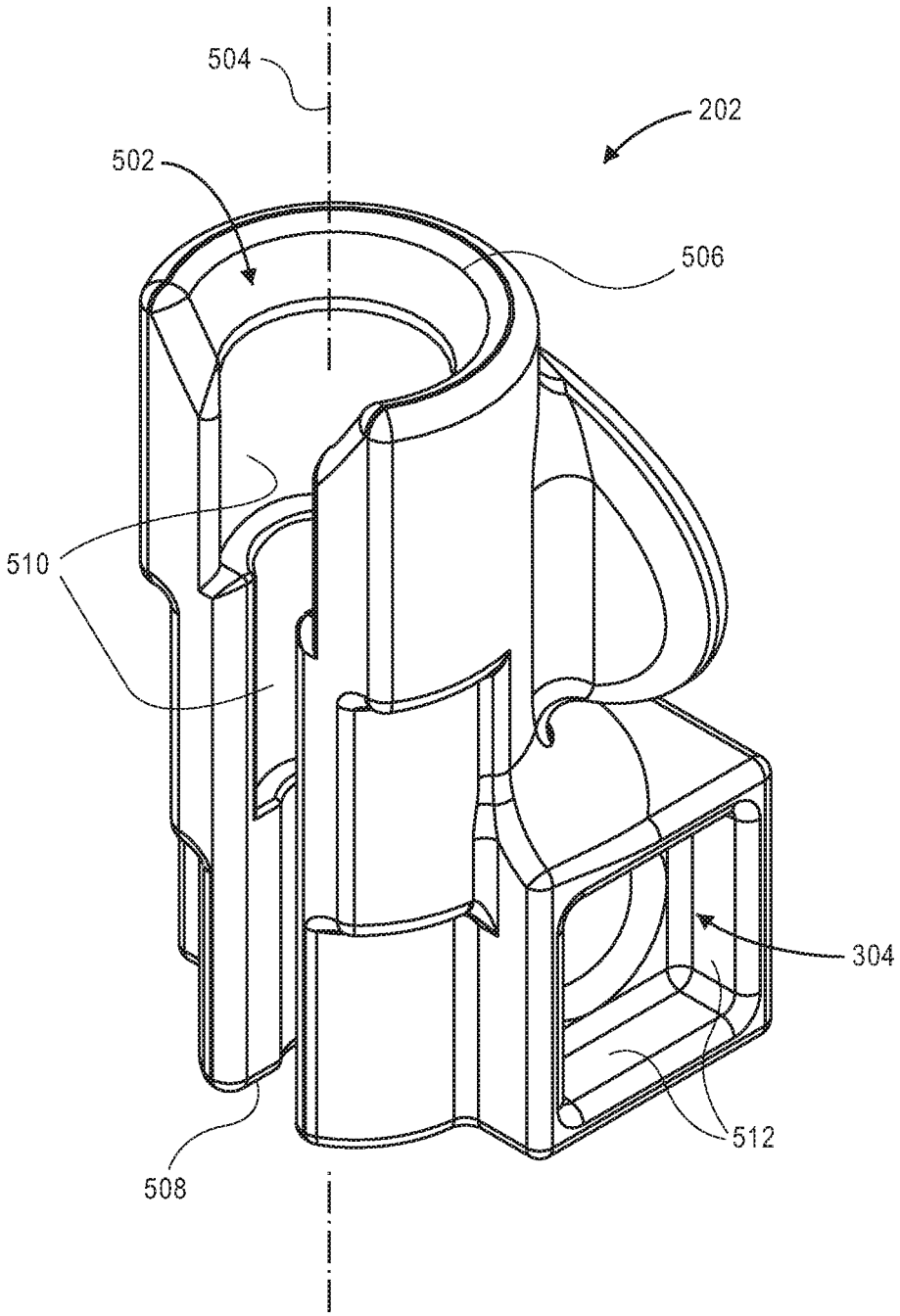
FIG. 5 is a perspective view of a jack clip in accordance with an embodiment.

Referring to FIG. 5, a perspective view of a jack clip is shown in accordance with an embodiment. The jack clip 202 may have a body that incorporates several features within a monolithic structure. For example, the jack clip 202 may be injection molded, machined, or otherwise formed, to include a jack channel 502 extending along a jack channel axis 504. In an embodiment, the jack channel 502 extends through the body of the jack clip 202 from an upper end 506 to a lower end 508. More particularly, a jack clip wall 510 may define the jack channel 502 that receives the audio jack 104 along the jack channel axis 504. The jack clip wall 510 may include a tapered and/or stepped contour from the upper end 506 to the lower end 508. For example, a first section of the jack clip wall 510 may have a first radius and a second section of the jack clip wall 510 below the first section may have a second, smaller radius. Accordingly, the first section may be sized to attach to a larger segment of an audio jack 104 strain relief and the second section may be sized to attach to a smaller segment of the audio jack 104 strain relief. The jack clip wall 510 may continue to decrease in radius along the jack channel axis 504, and thus, the jack channel 502 may be wider at the upper end 506 than at the lower end 508. The jack clip 202 may be sized and shaped to extend over all or most of the audio jack 104 strain relief, and thus, may provide additional support and strain relief to the audio jack 104 and cable 106 over the clipped region. In an embodiment, however, the jack clip 202 does not encapsulate the audio jack 104 completely. The jack clip 202 may expose part of the audio jack 104 so that, when removing the audio jack 104 from the port, the user is able to grab the audio jack 104 and the earphone keeper 110 while pulling the assembly out from the audio jack 104. That is, a user may grip both the audio jack 104 and the earphone keeper 110 when the earphone keeper 110 is clipped onto the audio jack 104 to allow for relative force to be applied to unclip the earphone keeper 110 without excessively loading the audio jack 104. Also, having access to the audio jack 104 in this manner may reduce the likelihood of damaging the internal wire connection when inserting or removing the audio jack 104 from electronic device 100.

The jack clip 202 may also include an integrally formed securement feature, e.g., the recess 304, to receive the earphone clip 204 in a direction orthogonal to the jack channel axis 504. More particularly, the recess 304 may be defined in part by a recess wall 512 extending in a peripheral direction around the recess 304. For example, the recess wall 512 may have two or more wall angles to create a recess 304 of a predetermined shape, such as a rectangular, triangular, or eye-shaped recess, to name a few possible shapes.

Figure 6:
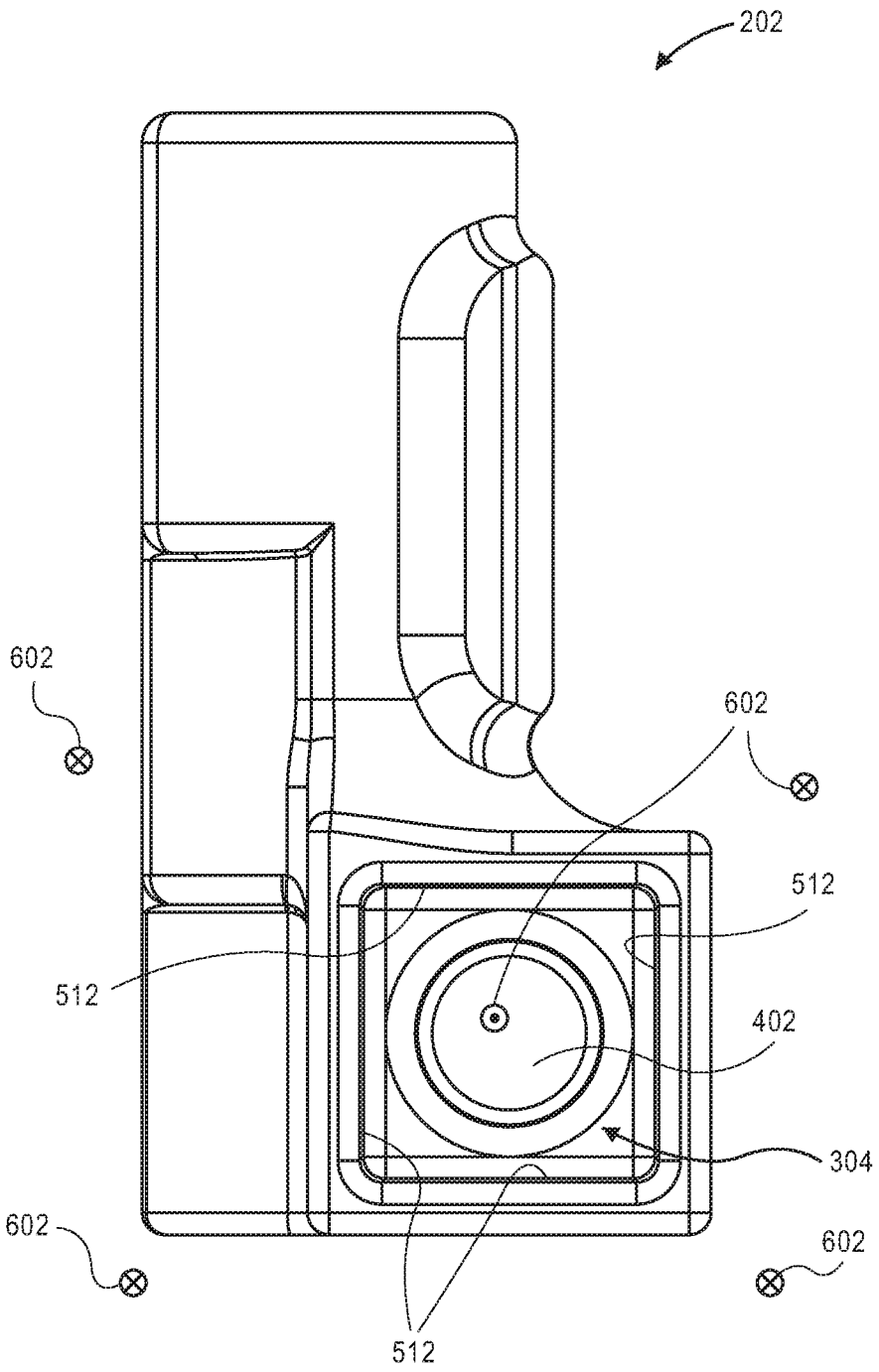
FIG. 6 is a side view of a jack clip in accordance with an embodiment.

Referring to FIG. 6, a side view of a jack clip is shown in accordance with an embodiment. The recess wall 512 may include several segments that interconnect to surround the recess 304. Furthermore, the recess 304 may have a depth, and the jack clip magnet 402 may be inserted into the body of the jack clip 202 through the recess 304. More particularly, the jack clip magnet 402 may be pressed into a bore formed in the jack clip 202 body in a secondary manufacturing operation, or alternatively, the magnet 402 may be integrally formed with the jack clip 202 body during an injection molding process, e.g., as a molding insert. Magnet 402 may be offset from jack channel axis 504 by a distance in a front-to-back direction (left to right direction of FIG. 6). Thus, jack channel axis 504 may extend through jack clip 202 in a vertical direction, and magnet 402 and/or a channel within which magnet 402 is located may extend through jack clip 202 in a transverse direction.

The magnet 402 in the jack clip 202 may generate the magnetic field such that magnetic field lines 602 are emitted into the recess 304 toward a surrounding environment. For example, magnetic flux from the magnet 402 may be directed out of the page through the recess 304 as shown in FIG. 6, and the magnetic flux may curve back into the page around the magnet 402 to form return magnetic field lines 602. As such, the magnet 402 may exert a magnetic force to attract other magnets 402 or magnetic materials that are inserted into the recess 304 and/or come within a range of the magnetic field.

Figure 7:
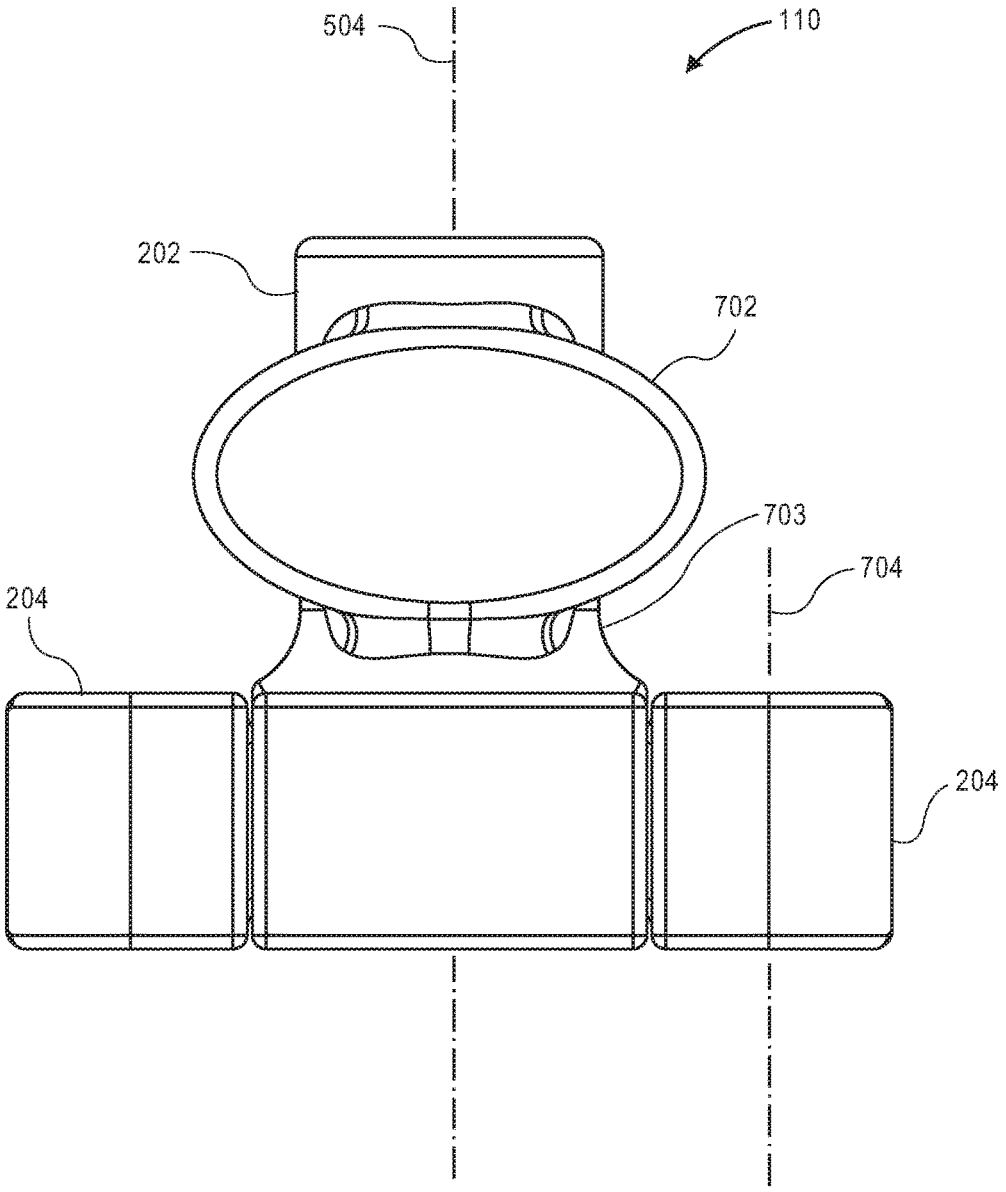
FIG. 7 is a back view of a jack clip in accordance with an embodiment.

Referring to FIG. 7, a back view of a jack clip is shown in accordance with an embodiment. In addition to the engagement features and the securement features, the jack clip 202 may include additional structural features integrally formed with the jack clip 202 body or attached to the jack clip 202 body in secondary manufacturing operations. For example, the jack clip 202 may include a spacer tab 702 connected to the jack clip 202 body. The spacer tab 702 may separate a portion of the jack clip 202 body, e.g., an outer wall 703 of the jack clip 202 opposite of the jack clip wall 510, from a portion of the earphones 102. More particularly, the earphone clips 204 may include the earphone clip channels (not shown) extending along an earphone channel axis 704 such that the earphone channel axis 704 aligns with the earphone speaker housing 108 (FIG. 1) when the speaker housing 108 is inserted in the earphone clip 204. Furthermore, the spacer tab 702 may have a width orthogonal to the jack channel axis 504 such that the earphones 102 speaker housing 108 presses against the spacer tab 702 and is therefore maintained at a minimum distance laterally offset from the jack channel axis 504. More particularly, the spacer tab 702 maintains a minimum distance between the outer wall 703 of the jack clip 202 and the speaker housing 108. This minimum distance allows for the speaker housing 108 to be easily gripped by a user when the user seeks to uncouple the earphone clip 204 from the jack clip 202. The spacer tab 702 is shown in FIG. 7 as having an oval profile, however, other profiles are suitable that include lateral edges that are offset from the jack channel axis 504 by a predetermined distance and that come between the jack channel 502 and a speaker housing 108 located in an earphone clip 204. The size and shape may also allow for printing, e.g., logos, icons, etc., to be printed directly on a flat portion of the spacer tab 702.

Still referring to FIG. 7, in an embodiment, the jack channel axis 504 and the earphone channel axis 704 are parallel to each other when the earphone clip 204 is releasably coupled to the jack clip 202. As such, an axis of the audio jack 104 may be parallel to an axis running through the speaker housing 108 when those components are positioned within respective clips. It will be appreciated, however, that the earphone clip 204 may be engaged with the jack clip 202 in various rotational configurations. That is, the recess 304 in the jack clip 202 and the protrusion 302 of the earphone clip 204 may be shaped such that the earphone clip 204 may be engaged with the jack clip 202 in a first rotational configuration, e.g., with the jack channel axis 504 and the earphone channel axis 704 parallel in the vertical direction within the page, or in a second rotational configuration, e.g., with the jack channel axis 504 coming out of the page in FIG. 7. Embodiments that allow the earphone clip 204 to engage with the jack clip 202 at various rotational orientations are described further below.

Figure 8:
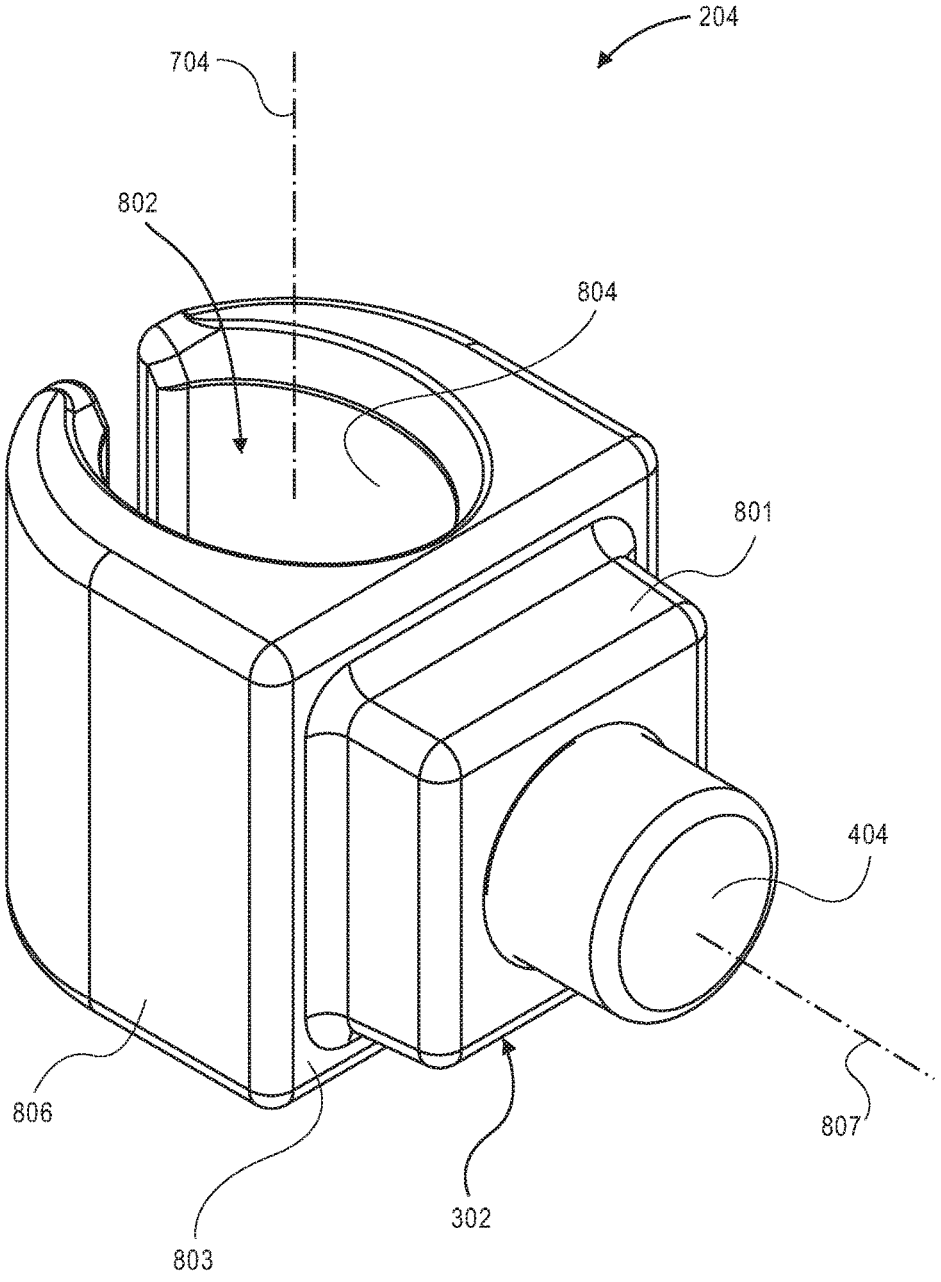
FIG. 8 is a perspective view of an earphone clip in accordance with an embodiment.

Referring to FIG. 8, a perspective view of an earphone clip is shown in accordance with an embodiment. The protrusion 302 of the earphone clip 204 may extend away from a body of the earphone clip 204. More particularly, the earphone clip 204 may be integrally formed in an injection molding, 3D printing, or machining process, such that the clip includes an earphone clip outer wall 806 including an outer surface having one or more faces, and the protrusion 302 may extend from one of those faces, e.g., base face 803. The protrusion 302 may include a protrusion wall 801 defining a portion of the protrusion 302. More particularly, the protrusion wall 801 may have two or more segments interconnected at wall angles such that the protrusion wall 801 surrounds an axis 807 passing through the magnetic insert 404. Furthermore, as described above, the protrusion wall 801 may define a profile of the protrusion 302 and that profile may match a profile of the recess 304 in the jack clip 202. As shown, the protrusion wall 801 may include four segments interconnected to form a rectangular protrusion 302 and that protrusion profile may engage with a corresponding recess profile at rotational increments of 90°.

The earphone clip 204 may also include an earphone clip channel 802 extending through the body of the earphone clip 204 along the earphone channel axis 704. More particularly, an earphone clip wall 804 may extend around the earphone channel axis 704 to define the earphone clip channel 802. The earphone clip wall 804 may have a contour to receive a portion of the earphones 102, e.g., to hold a stem portion of the speaker housing 108 or to grasp around the cord of the earphones 102 near the speaker housing 108. In an embodiment, the magnetic insert 404, which may include a permanent magnet or a magnetic material, may be pressed into a counterbore in the protrusion 302 during a secondary manufacturing operation or the magnetic insert 404 may be integrally formed with the earphone clip 204, e.g., as a molding insert.

It will be appreciated that the above description of the jack clip 202 and the earphone clip 204 has generally referred to the clip structure as including respective channels to receive an earphone component, as well as clip walls that define those channels and are sized and shaped to conform to the intended earphone component. The generalization of this description is used so as to not prejudice the reader against other possible clip configurations. That is, one skilled in the art will appreciate that a variety of clip configurations may be used to permit the clip bodies to attach to the earphone components. Nonetheless, in an embodiment, the clip structures have slots running through a wall of the clip to expose the clip channels to a surrounding environment. As such, the slotted walls form flexible clip fingers that can deflect resiliently outward to permit the passage of an earphone component, e.g., a speaker housing 108, and to then resiliently deflect inward to the initial configuration such that the earphone component is held within the clip channel. Additional description of this clip structure is reserved so as to not unnecessarily obscure the invention, however, structural features such as the clip fingers and the wall slots will be apparent to one skilled in the art when reading this description and viewing the accompanying figures.

Figure 9:
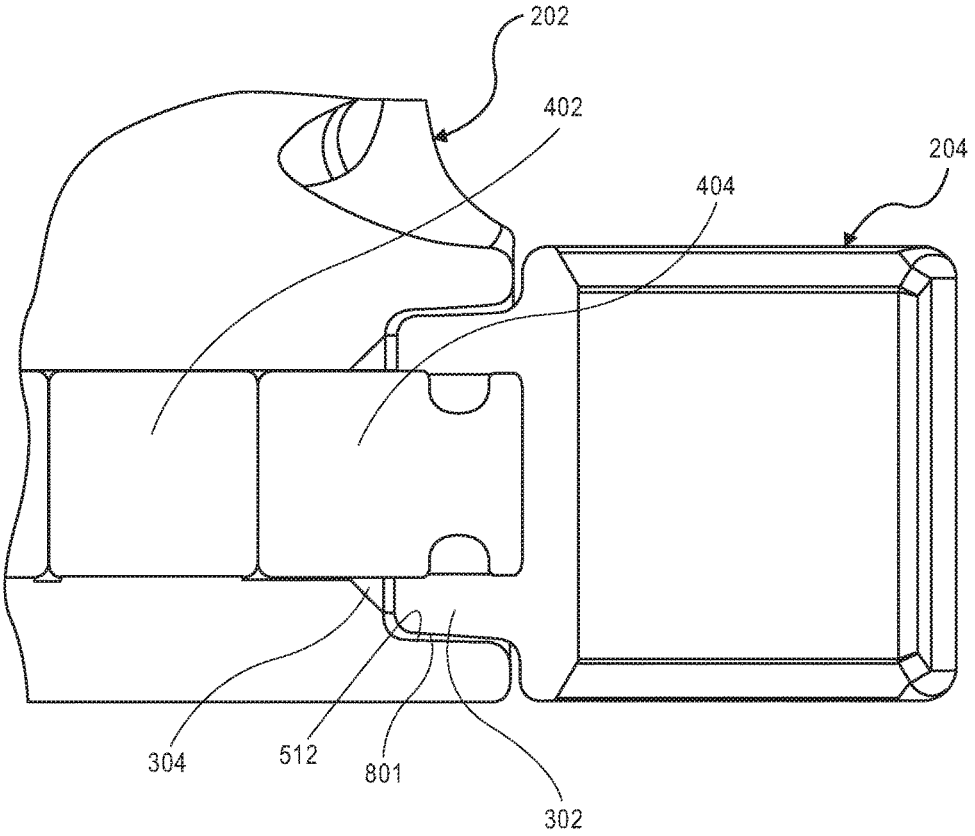
FIG. 9 is a sectional view of an earphone clip releasably coupled to a jack clip in accordance with an embodiment.

Referring to FIG. 9, a sectional view of an earphone clip releasably coupled to a jack clip is shown in accordance with an embodiment. In an embodiment, when the protrusion 302 of the earphone clip 204 is inserted into the recess 304 of the jack clip 202, one or more segments of the protrusion wall 801 face respective segments of the recess wall 512. As such, the walls may come into sliding engagement to fix a location of the earphone clip 204 relative to the jack clip 202. When the protrusion 302 is received in the recess 304, the magnetic insert 404 may come within the magnetic field generated by the magnet 402, and the earphone clip 204 may thus become releasably coupled to the jack clip 202. When the earphone clip 204 is releasably coupled to the jack clip 202, the magnetic field lines 602 of the magnetic field may pass from the magnet 402 through the recess 304 into the magnetic insert 404 of the earphone clip 204. The magnetic insert 404 may abut or press directly against the magnet 402, or alternatively, a gap may remain between the magnet 402 and the magnetic insert 404 when the earphone clip 204 is fully engaged with the jack clip 202.

Figure 10A:
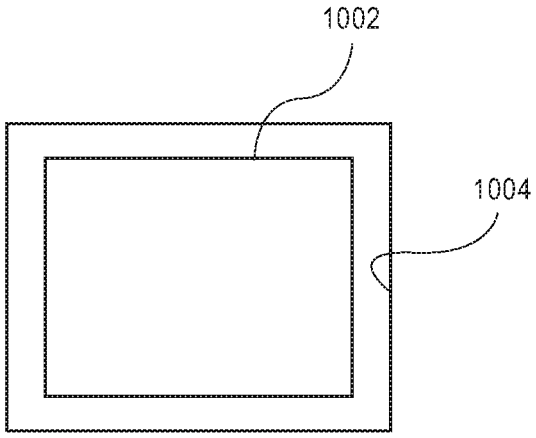
FIGS. 10A-10B are pictorial views of protrusion and recess contours in accordance with an embodiment.

Referring to FIG. 10A, a pictorial view of a protrusion and a recess contour is shown in accordance with an embodiment. As described above, cross-sectional profiles of the corresponding securement features of the jack clip 202 and the earphone clips 204 may be formed to permit rotational variation when the components are engaged. The protrusion wall 801 may form a protrusion contour 1002, i.e., a profile formed by a path extending along the protrusion wall 801 around an axis passing through the protrusion 302. Similarly, the recess wall 512 may form a recess contour 1004, i.e., a profile formed by a path extending along the recess wall 512 around an axis passing through the recess 304. The protrusion contour 1002 and the recess contour 1004 may be complementary to each other in that they may have a same or similar shape. As such, the recess wall 512 may resist rotation of the protrusion wall 801 when the protrusion 302 is inserted into the recess 304. For example, the recess contour 1004 and the protrusion contour 1002 may have non-circular shapes, e.g., the rectangular shapes shown in FIG. 10A, and the corners of the contours may prevent rotation of the engaged clips.

Figure 10B:
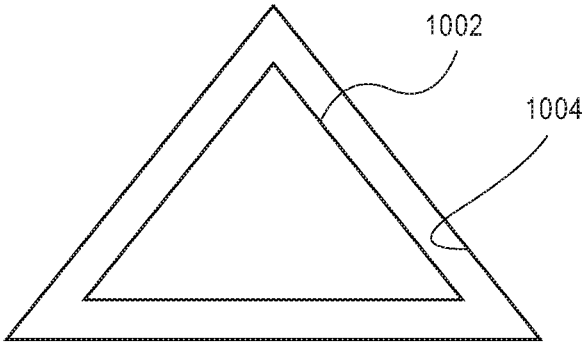

Referring to FIG. 10B, a pictorial view of a protrusion and a recess contour is shown in accordance with an embodiment. In an embodiment, the protrusion contour 1002 and the recess contour 1004 include triangular profiles, which are also non-circular shapes, such that the contour corners match and the recess wall 512 resists rotation of the protrusion wall 801 when the protrusion 302 is inserted into the recess 304. Other contour shapes may be used, and in an embodiment, the protrusion contour 1002 differs from the recess contour 1004. For example, the protrusion contour 1002 may be rectangular and the recess contour 1004 may be triangular, however, the shapes may be sized such that rotation of the triangular recess contour 1004 within the rectangular protrusion contour 1002 is still prevented. It will also be appreciated that the protrusion contour 1002 and the recess contour 1004 may both be circular-shaped. For example, if rotational movement between the engaged components is desired, forming the recess 304 and the protrusion 302 in matching cylindrical or frustoconical shapes will allow for the desired rotational movement.

Figure 11:
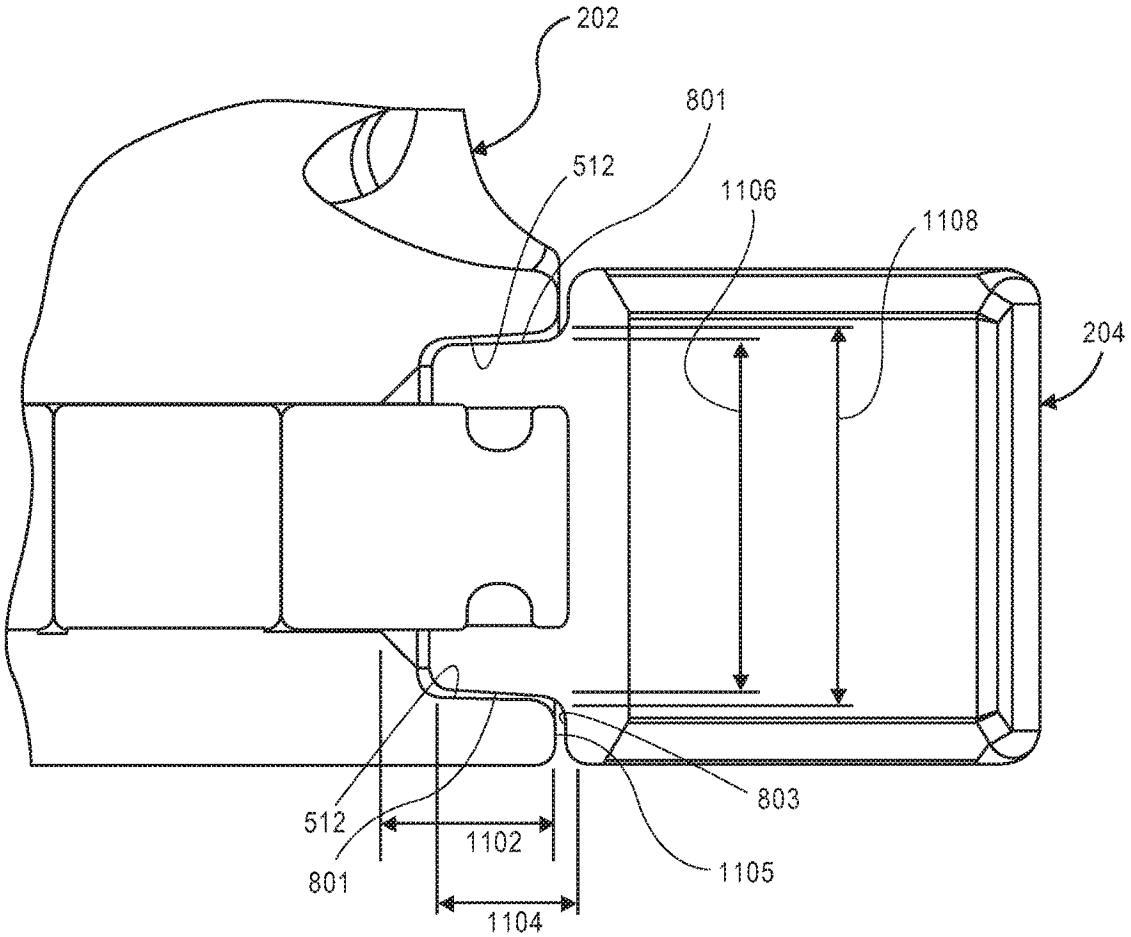
FIG. 11 is a sectional view of an earphone clip releasably coupled to a jack clip in accordance with an embodiment.

Referring to FIG. 11, a sectional view of an earphone clip releasably coupled to a jack clip is shown in accordance with an embodiment. In addition to the relative geometric shapes of the recess 304 and the protrusion 302, the dimensions of those clip features may also allow for stable engagement between the jack clip 202 and the earphone clip 204. For example, the relative dimensions between the protrusion 302 and the recess 304 may allow for the earphone clip 204 to stably cantilever from the jack clip 202. In an embodiment, the recess 304 includes a recess depth 1102, which may be defined as a depth of the recess wall 512. Furthermore, the protrusion 302 may include a protrusion height 1104, which may be defined as a height of the protrusion wall 801. The protrusion height 1104 and the recess depth 1102 may be similar, as shown in FIG. 11, such that a lateral edge of the recess wall 1105 abuts against a face 803 of the earphone clip 204 body from which the protrusion 302 extends.

The recess 304 and the protrusion 302 may also have corresponding widths. For example, the recess 304 may have a recess width 1106 defined by a distance from one segment of the recess wall 512 to another segment of the recess wall 512 across the recess 304. Similarly, the protrusion 302 may have a protrusion width 1108 defined by a distance from one segment of the protrusion wall 801 to another segment of the protrusion wall 801 across the protrusion 302. The protrusion width 1108 may be less than the recess width 1106 to allow for the protrusion 302 to be inserted into the recess 304 in a sliding fit. Therefore, there may be a difference between the recess width 1106 and the protrusion width 1108, e.g., a slip fit gap.

The depth of the recess 304 may have a predetermined relationship to the widths of the recess 304 and/or the protrusion 302. For example, the recess depth 1102 may be greater than the difference between the recess width 1106 and the protrusion width 1108. In an embodiment, the recess depth 1102 is at least ten times greater than the difference. Thus, the protrusion 302 may fit snugly within the recess 304 and may extend into the recess 304 far enough that cantilever loads placed on the earphone clip 204 will not result in the disengagement of the protrusion 302 from the recess 304. That is, the earphone clip 204 may be stably cantilevered from the jack clip 202.

Other features of the earphone keeper 110 will be apparent to one skilled in the art when reading the description above and viewing the accompanying figures. For example, it will be appreciated that the earphone keeper 110 may be shaped to create certain predetermined dimensional relationships between the components that the earphone keeper 110 interacts with. The distance between the speaker housing 108 and the audio jack 104 created by the spacer tab 702 was described above. In addition, certain features of the earphone keeper 110 may create predetermined distances between the earphones 102 and the electronic device 100. For example, referring again to FIG. 5, it is shown that the upper end 506 of the jack clip wall 510 may be axially separated from the magnet 402, which is aligned with the recess 304. Accordingly, the upper end 506 may also be axially separated from the earphone clip 204 when the earphone clip 204 is engaged with the jack clip 202. Referring back to FIG. 1, it can be seen that a minimum distance may be required between the electronic device 100 and the earphone clip 204 when the audio jack 104 is plugged in such that the speaker housing 108 fits between the earphone clip 204 and the electronic device 100. Accordingly, the upper end 506 of the jack clip wall 510 may be axially separated from the magnet 402 and/or the recess 304 by a minimum distance to ensure that the accommodative space for the speaker housing 108 is provided. This distance will of course depend upon other structural relationships, e.g., the distance between the upper end 506 and the electronic device 100 that results when the jack clip wall 510 is clipped onto the predetermined location of the audio jack 104, however, in an embodiment the minimum distance between the upper end 506 and the magnet 402 is at least half of a vertical height of the speaker housing 108. More particularly, the minimum separation distance may be at least 0.5 inch. Other such dimensional relationships between the components of the earphone keeper 110 will be apparent from the above description.

The earphone keeper 110 may include non-magnetic retention features on both the jack clip 202 and the earphone clips 204 to retain the earphone clips 204 at the jack clip 202 when the securement features are engaged. For example, the earphone keeper 110 may include one or more mechanical interlock features on the protrusion wall 801 or the recess wall 512 to engage a mating interlock feature on the other one of the protrusion wall 801 or the recess wall 512. In an embodiment, the protrusion 302 or the recess wall 512 include a detent to snap into a mating bore on the other of the protrusion 302 or the recess wall 512 and to interlock the earphone clips 204 to the jack clip 202. Alternatively, an O-ring may be mounted on one or more of the protrusion wall 801 or the recess wall 512 to engage with a mating groove on the other of the protrusion wall 801 or the recess wall 512 and to interlock the earphone clips 204 and the jack clip 202. Other retention features to interlock earphone clip 204 to jack clip 202 may be contemplated within the scope of this description.

In the foregoing specification, the invention has been described with reference to specific exemplary embodiments thereof. It will be evident that various modifications may be made thereto without departing from the broader spirit and scope of the invention as set forth in the following claims. The specification and drawings are, accordingly, to be regarded in an illustrative sense rather than a restrictive sense.

What is claimed is:

1. An earphone keeper, comprising:

a jack clip having a jack clip wall around a jack channel, wherein the jack channel extends along a jack channel axis, wherein the jack clip includes a recess wall defining a recess; and a plurality of earphone clips, each earphone clip having an earphone clip wall around an earphone clip channel, wherein each earphone clip includes a protrusion having a protrusion wall, wherein the recess wall faces the protrusion wall when the protrusion is inserted into the recess.

2. The earphone keeper of claim 1, wherein the jack clip wall includes an upper end axially separated from a lower end along the jack channel axis, and wherein the upper end is axially separated from the recess wall by a minimum distance.

3. The earphone keeper of claim 2, wherein the jack channel is wider at the upper end than at the lower end.

4. The earphone keeper of claim 2, wherein the jack channel partially surrounds an audio jack to allow simultaneous access to the jack clip and the audio jack when the audio jack is inserted into or removed from an electronic device.

5. The earphone keeper of claim 1, wherein the recess wall has a recess contour, wherein the protrusion wall has a protrusion contour, and wherein the recess contour and the protrusion contour have a same non-circular shape such that the recess wall resists rotation of the protrusion wall when the protrusion is inserted into the recess.

6. The earphone keeper of claim 5, wherein the recess includes a recess depth and a recess width, wherein the protrusion includes a protrusion height and a protrusion width, wherein the recess depth is greater than the protrusion height, and wherein the recess width is greater than the protrusion width.

7. The earphone keeper of claim 1, wherein the jack clip is to receive an audio jack in the jack channel, and wherein the jack clip remains connected to the audio jack when the audio jack is inserted or removed from an electronic device and the jack clip is coupled to the plurality of earphone clips.

8. The earphone keeper of claim 1, wherein the jack clip includes a magnet, and wherein magnetic field lines of the magnet pass from the magnet through the recess and the protrusion when the earphone clip is releasably coupled to the jack clip.

9. The earphone keeper of claim 8, wherein each earphone clip includes a magnetic insert, wherein the magnetic inserts are attracted to the magnet in the jack clip to releasably couple the earphone clips to the jack clip, and wherein the magnetic inserts are not magnetically attracted to each other.

10. The earphone keeper of claim 1, wherein the protrusion or the recess wall includes a mechanical engagement feature to press against the other of the protrusion or the recess wall to engage the jack clip and the earphone clips.

11. The earphone keeper of claim 10, wherein the mechanical engagement feature includes a detent.

12. The earphone keeper of claim 10, wherein the mechanical engagement feature includes an O-ring mounted on the protrusion wall or the recess wall.

13. An earphone keeper, comprising:

a jack clip having a jack clip wall around a jack channel, and a magnet, wherein the jack channel extends along a jack channel axis, and wherein the magnet produces magnetic field lines; and a plurality of earphone clips, each earphone clip having an earphone clip wall around an earphone clip channel, and a magnetic insert, wherein the magnetic inserts are magnetically attracted to the magnet in the jack clip to releasably couple the earphone clips to the jack clip, and wherein the magnetic inserts are not attracted to each other.

14. The earphone keeper of claim 13, wherein the jack clip wall includes an upper end axially separated from a lower end along the jack channel axis, and wherein the upper end is axially separated from the magnet by a minimum distance.

15. The earphone keeper of claim 14, wherein the jack channel is wider at the upper end than at the lower end.

16. The earphone keeper of claim 13, wherein the jack clip includes a recess wall defining a recess, wherein each earphone clip includes a protrusion having a protrusion wall, wherein the protrusions insert into the recess such that the recess wall faces the protrusion wall and the magnetic field lines pass from the magnet through the recess and the protrusion when the earphone clip is releasably coupled to the jack clip.

17. The earphone keeper of claim 16, wherein the recess wall has a recess contour, wherein the protrusion wall has a protrusion contour, and wherein the recess contour and the protrusion contour have a same non-circular shape such that the recess wall resists rotation of the protrusion wall when the protrusion is inserted into the recess.

18. The earphone keeper of claim 17, wherein the recess includes a recess depth and a recess width, wherein the protrusion includes a protrusion height and a protrusion width, wherein the recess depth is greater than the protrusion height, and wherein the recess width is greater than the protrusion width.

19. The earphone keeper of claim 13, wherein the jack clip is to receive an audio jack in the jack channel, and wherein the jack clip remains connected to the audio jack when the audio jack is inserted or removed from an electronic device and the jack clip is coupled to the plurality of earphone clips.

* * * * *